US005634739A

United States Patent [19]

Armstrong

[11] Patent Number: 5,634,739

[45] Date of Patent: Jun. 3, 1997

[54] MANHOLE CASTING POSITIONING APPARATUS AND METHOD

[76] Inventor: Ronald B. Armstrong, 31910 Charlotte Ave., Abbotsford, British Columbia, Canada, V2T 4J3

[21] Appl. No.: 611,418

[22] Filed: Mar. 5, 1996

[51] Int. Cl.[6] ..... E02D 29/14

[52] U.S. Cl. ..... 404/26; 52/20

[58] Field of Search ..... 404/25, 26; 52/19, 52/20, 21

[56] References Cited

U.S. PATENT DOCUMENTS

| | | | |
|---|---|---|---|
| 3,611,889 | 10/1971 | Levinson | 404/26 |
| 4,666,333 | 5/1987 | Armstrong | 404/26 |
| 5,360,131 | 11/1994 | Phillips et al. | 404/26 X |

*Primary Examiner*—James A. Lisehora
*Attorney, Agent, or Firm*—Seed and Berry LLP

[57] ABSTRACT

The present invention provides an improvement in manhole casting positioning apparatus and methods. In particular there is provided a casting positioning apparatus; for positioning a casting in relation to an upper end of a manhole, which comprises an inner sleeve comprising a rigid hollow cylinder having an annular flange extending around the upper circumference thereof. The diameter of the cylinder is less than that of the manhole lid opening. An annular resilient rubber ring or skirt whose inner diameter is slightly less than the outer diameter of the inner sleeve and whose outer diameter is greater than that of the manhole lid opening is stretched around the outer surface of the cylindrical inner sleeve. The lower end of the cylindrical inner sleeve is inserted into the upper end of the manhole, and lowered until the lower surface of the rubber ring rests on the upper edge of the manhole lid. Pressure is then applied downwardly on the flange of the sleeve to push it down to the desired height and slope. The ring is then tightened in the selected position with a tightening band and the casting is then mounted in position on the flange of the inner sleeve. A cylindrical outer sleeve is then placed around the casting and concrete poured to fill the annular space between inner and outer sleeves to thereby secure the casting.

5 Claims, 5 Drawing Sheets

MANHOLE CASTING POSITIONING APPARATUS AND METHOD

FIELD OF THE INVENTION

The present invention relates to manhole casting installation apparatus and methods. In particular the invention relates to a casting positioning apparatus, for positioning a casting in relation to an upper end of a manhole, and cementing the casting in place on the manhole at the desired height and slope.

BACKGROUND OF THE INVENTION

The present inventor is also the inventor of the manhole casting positioning apparatus disclosed in U.S. Pat. No. 4,666,333 issued May 19, 1987. Manholes for sewers and the like are typically assembled by stacking a number of precast, cylindrical concrete barrel sections to approximately the desired height. In order to allow some adjustability of the placement of the iron manhole casting on the end of the manhole in relation to the road grade, a 1-inch to 20-inch space is typically left between the manhole lid and the iron casting. Previously this space was filled with layers of bricks, which is expensive and time consuming. The apparatus disclosed in U.S. Pat. No. 4,666,333 provides a two-piece form, consisting of an inner and outer sleeve, which replaces the brick and mortar method.

In the inventor's apparatus disclosed in U.S. Pat. No. 4,666,333, the inner sleeve consists of a single planar plastic piece joined end-to-end to form a cylinder which is expandable by means of turnbuckle-type expansion mechanisms. The outer sleeve is in the form of a belt with a receptacle at one end through which the other end passes and is secured to form a cylinder. The inner sleeve is first expanded into the manhole opening and set to the required slope. The casting is mounted on the inner sleeve, and the outer sleeve, which has a diameter greater than that of the base of the casting, is placed around the casting. Concrete is then poured between the inner and outer sleeves and up over the base of the casting. After the concrete has set the sleeves are removed.

The previous casting positioning apparatus incorporated a number of turnbuckles in connection with the inner sleeve (to tighten the sleeve against the manhole) which were time consuming to adjust and relatively expensive to manufacture. Also there was a possibility of leakage of water through the inner form of the prior device. A casting positioning apparatus which is simpler, more easily adjustable prior to pouring of the concrete, and provides a leak-proof inner surface is therefore desired.

SUMMARY OF THE INVENTION

The invention therefore provides a method of cementing a casting on a manhole lid opening comprising the steps of:

a) providing a cylindrical inner sleeve having upper and lower edges and a circumferential flange on said upper edge;

b) sliding a rubber ring on the inner sleeve, the rubber ring having an inner diameter less than the outer diameter of the cylinder and an outer diameter greater than the manhole;

c) placing said inner sleeve on the manhole lid with the rubber ring resting on the upper surface of the manhole lid and applying pressure to the upper edge of the inner sleeve to thereby slide the sleeve to the desired height relative to the manhole lid;

d) tightening the rubber ring against the inner sleeve;

e) placing the casting on the upper edge of the inner sleeve;

f) providing an outer cylindrical sleeve having a diameter greater than the diameter of the casting around the casting; and g) pouring concrete into the space formed between the inner sleeve and the outer sleeve.

BRIEF DESCRIPTION OF THE DRAWINGS

In drawings which illustrate a preferred embodiment of the invention.

DETAILED DESCRIPTION OF A PREFERRED EMBODIMENT

Figure 1:
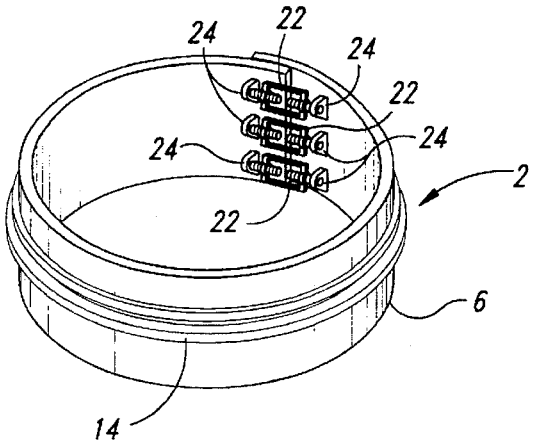
Fig. 1 (Prior Art)
FIG. 1 is a perspective view of the inner sleeve of the inventor's prior apparatus as disclosed in U.S. Pat. No. 4,666,333.
Figure 2:
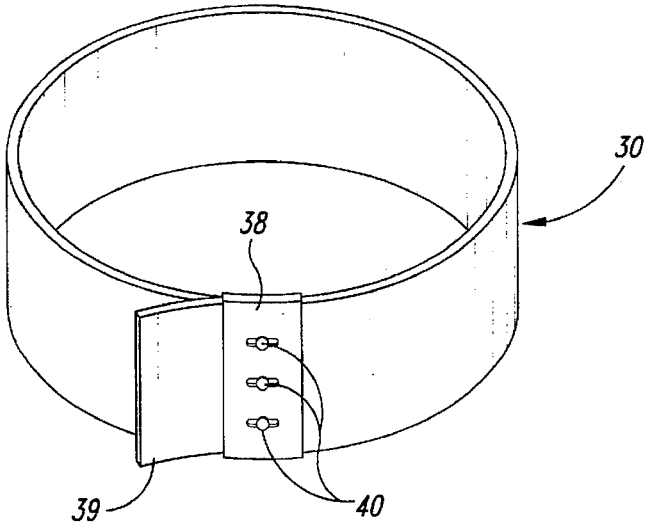
Fig. 2 (Prior Art)
FIG. 2 is a perspective view of the outer sleeve of the inventor's prior apparatus as disclosed in U.S. Pat. No. 4,666,333.
Figure 3:
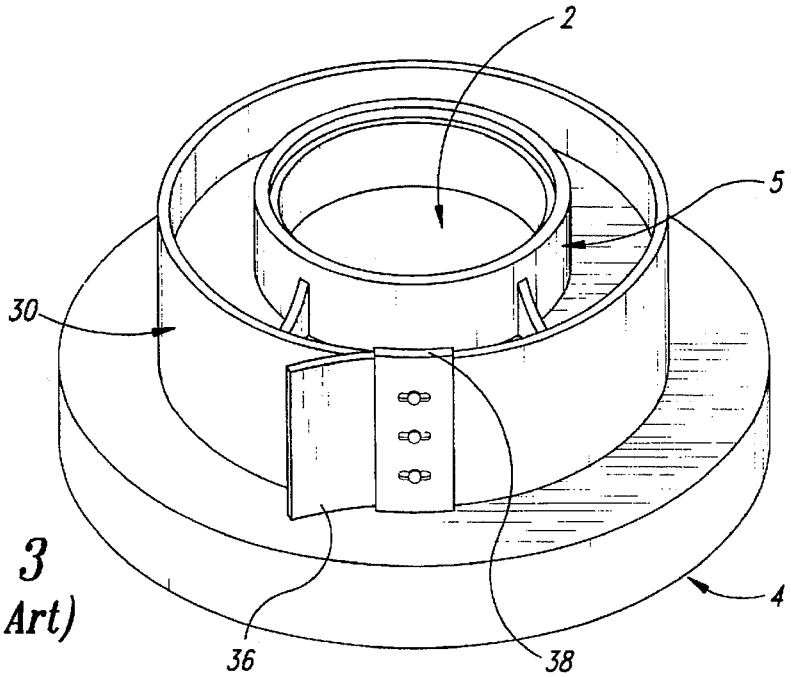
Fig. 3 (Prior Art)
FIG. 3 is a perspective view of the inventor's apparatus as disclosed in U.S. Pat. No. 4,666,333 installed on a manhole lid opening with a casting in place on the inner sleeve, and the outer sleeve in place.

The inventor's previous designs for inner and outer forms for a manhole casting positioning apparatus as disclosed in U.S. Pat. No. 4,666,333 are shown in FIGS. 1, 2 and 3 respectively. The inner form or sleeve 2 comprises a single piece belt-like sleeve 6. An expandable gasket 14 is provided around the sleeve to grip the interior surface of the manhole lid opening. Turnbuckles 22 are secured at three locations to the two ends of the sleeve by permanently mounted studs 24. Rotation of the turnbuckles expands or contracts the sleeve 4. Outer sleeve 30 is also in the form of a continuous belt. It is adjusted by drawing end 39 through receptacle 38 and tightening wing nuts 40. FIG. 3 shows a casting 5 mounted on the inner sleeve 2 in place in a manhole lid 4, with the outer sleeve 30 in place for cement to be poured.

Figure 4:
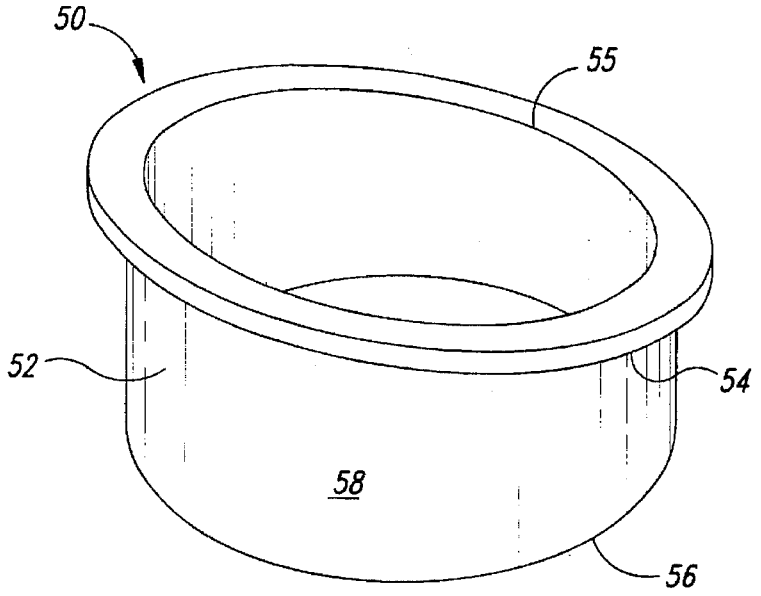
FIG. 4 is a perspective view of the inner sleeve of the present invention.

The improved inner form is shown as 50 in FIG. 4. It consists of a smooth hollow tube or cylinder 52 of rigid extruded plastic such as polyethylene or polyvinyl chloride (PVC). It has an annular flange 54 along the upper edge 55 thereof and a lower edge 56. Flange 54 extends about 4 inches (2 inches on each side) outwardly of cylinder 52 in order to support a casting whose base opening is larger than the inner sleeve diameter. The upper edge 55, and thus also flange 54, is set at an angle to a plane perpendicular to the longitudinal axis of the cylinder 52. For example, for a sleeve which is 23 inches in diameter, the flange will drop about 2 inches from one side of the sleeve to the other. The diameter of cylinder 52 is slightly less than that of the manhole lid opening, and the height of the cylinder is greater than the height which the sleeve must raise the casting above the manhole lid to reach the road grade. For example, a typical manhole lid opening is 24 inches in diameter. The cylindrical portion of the inner sleeve for such an application will have an outer diameter of 23 inches, and flange 54 will have an outer diameter about 4 inches greater, 27 inches in this example. The height on the high side of the seeve is about 22 inches and about 20 inches on the low side.

Figure 5:
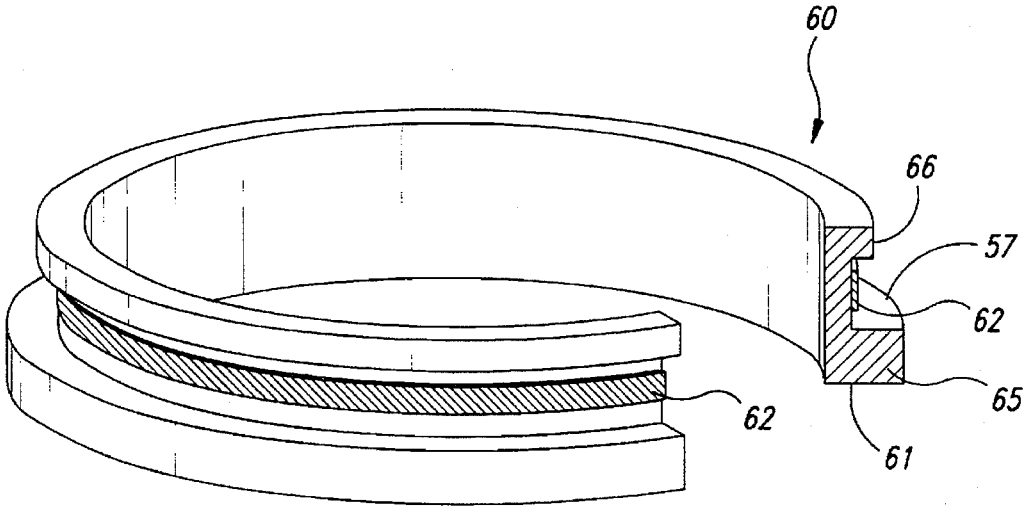
FIG. 5 is a perspective view of the rubber ring and hose clamp of the present invention partly cut away to show a cross-section.

An annular rubber ring 60 as shown in FIG. 5, formed of a flexible extruded rubber, is provided, whose inner diameter is slightly less than the diameter of the outer surface 58 of inner sleeve 50 and whose outer diameter is greater than that of the manhole lid opening. For the example noted above, the ring outer diameter will be about 26 inches. Ring 60 is L-shaped in cross-section, typically 5/16 inches thick at the top and 1 and ½ inches thick at the bottom. Ring 60 is stretched slightly and slid over the smooth outer surface 58 of the cylindrical inner sleeve 52. It has a slot or groove 57 in the upper section thereof into which a hose clamp 62 is installed to tighten ring 60 against the outer surface of the cylindrical inner sleeve, leaving a small upper lip 66. Ring 60 is of a type of rubber material such that it grips surface 58 securely when tightened by the hose clamp but permits the smooth surface 58 of cylinder 52 to slide against it when the hose clamp is not tightened. The hose clamp is of standard description, consisting of a stainless steel band having a slotted end which fits into a screw shank which draws the end in and tightens the clamp when the screw is rotated. Typically the lower section 65 will be ⅝ inches high, the slot section 57 about ⅞ inches high and lip 66 about ⅛ inch high.

Figure 6:
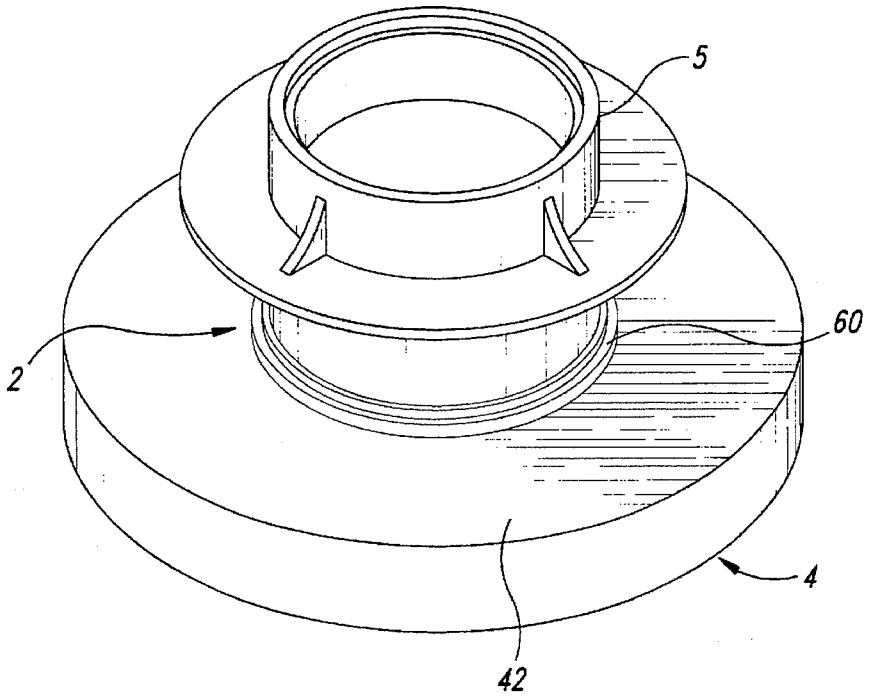
FIG. 6 is a perspective view showing the inner sleeve of the present invention with the rubber ring and hose clamp installed and casting in place, on a manhole lid
Figure 7:
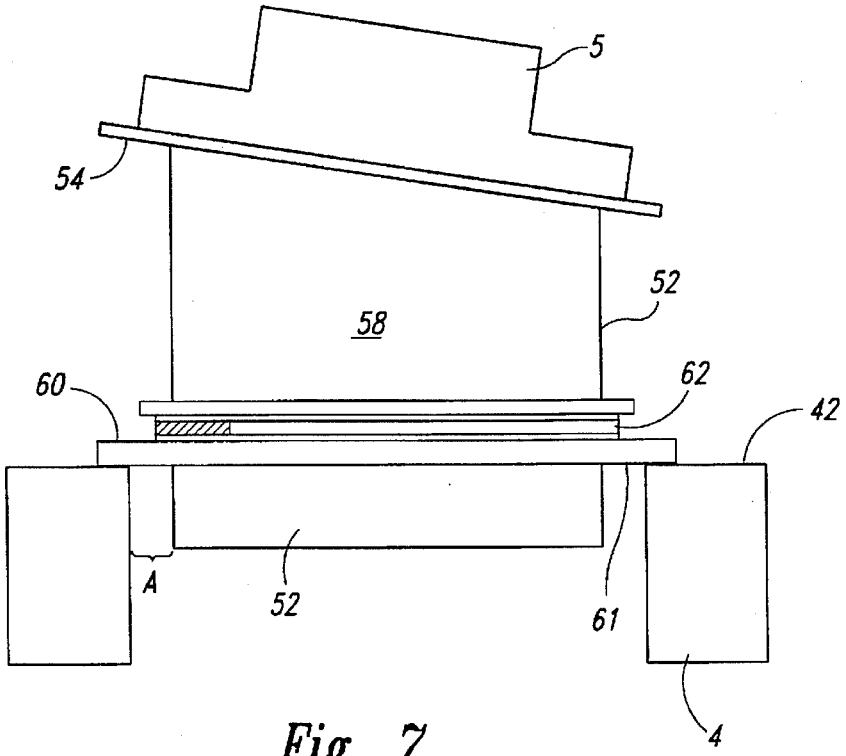
FIG. 7 is a simplified schematic view, partly in cross-section, not to scale, showing the inner sleeve of the present invention with the rubber ring and hose clamp installed and casting in place, on a manhole lid.
Figure 8:
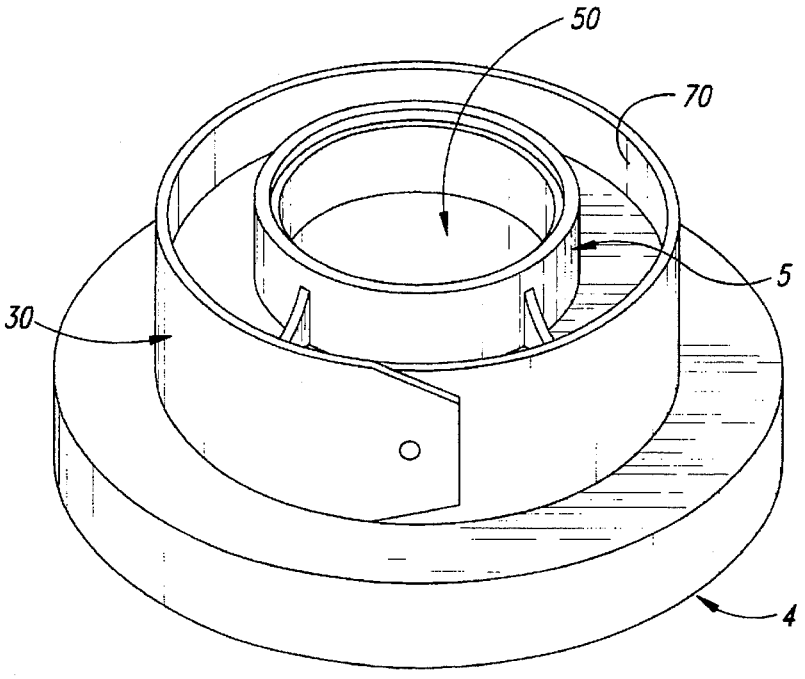
FIG. 8 is a perspective view showing the inner sleeve of the present invention with the rubber ring and hose clamp installed and casting in place, on a manhole lid.
Figure 9:
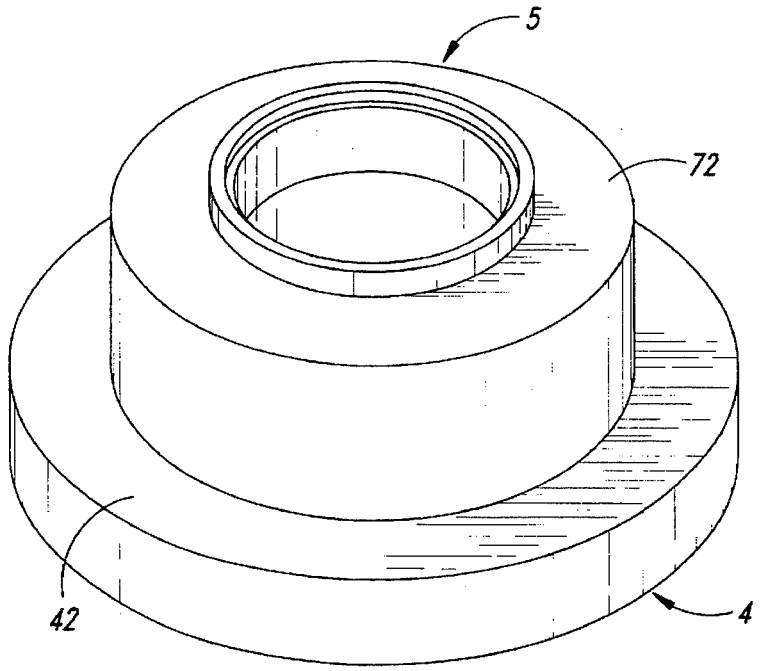
FIG. 9 is a perspective view showing the finished, mounted casting with the outer sleeve removed.

The lower end of the cylindrical inner sleeve 52 is inserted into the upper end of the manhole lid opening, and lowered until the lower surface 61 of the rubber ring 60 rests on the upper surface 42 of the manhole lid. The casting is placed on the sleeve as shown in FIG. 6 and 7, and pressure can then be applied downwardly, by hand, mallet or the like, on the casting, and thus on flange 54 of the sleeve, to push it down to the desired height and slope or angle. The gap A between the sleeve and the manhole lid opening permits the sloping of the sleeve to be adjusted. The hose clamp 62 is then tightened by screwdriver to secure the ring 60 to the inner sleeve 50 and fix the position of the sleeve in the manhole. After the hose clamp 62 is securely tightened, the relative position of the sleeve 50 is marked on the manhole lid surface 42 so the sleeve can later be returned to the same position, and the casting and sleeve are removed. The lower portion of the inner sleeve 50 below the ring 60 can then be cut off using a cut-off saw to eliminate any impediment this might present to a worker entering the manhole. The inner sleeve 50 is then placed back on the manhole lid using the marker line to restore it to its previous position, with the rubber ring 60 resting on the manhole lid 4. The casting 5 is then replaced in position on the flange 54 of the inner sleeve 50. A cylindrical outer sleeve 30 is then placed around the casting and concrete poured to fill the annular space between inner and outer sleeves 50, 30. After the concrete has hardened, the outer sleeve may be removed as shown in FIG. 9, leaving hardened concrete casing 72 around casting 5.

Figure 10:
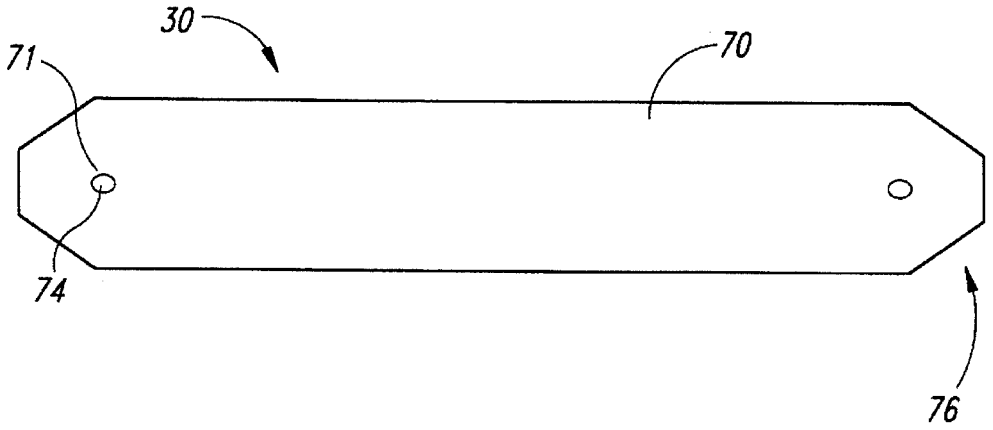
FIG. 10 is a plan view of the unassembled outer sleeve.

A two piece outer sleeve 30 of hardboard or plastic, which is pivotally attached at either end for easy storage and packaging is preferred. The outer cylindrical form can be formed of two hardboard pieces, each one 70 (see FIG. 10) about ⅛ inches thick and 66 inches long and 16 inches wide. The two pieces are joined at holes 71, centrally located about 4 inches from the end of the board, by binding screws 74. The binding or assembly screw has a flat head on either end, with a male end screwing into a female end ("Chicago screws"). In this way the screw heads are almost flush with the surface of the hardboard, and the entire form stacks neatly for storage and transportation. To use the form, one side is pivoted across the other until they snap out into a full circle. The corners 76 of the hardboard are preferably cut off to facilitate the pivoting of the two boards.

It is often necessary to add an extra rung to be cemented in as the top rung for the manhole ladder, since the rungs for the ladder are generally spaced 12 inches apart and there must be a safe spacing from the casting down to the top rung. To provide a top rung, two holes (not shown) are drilled through the inner sleeve 50 at the proper location. The two legs of a C-shaped rung (not shown) are inserted through the holes and held in place while concrete is poured in the space between inner and outer sleeves.

An advantage of the use of the inner sleeve structure and rubber ring of the present invention is that it provides 1) a smooth leak-proof surface on the inside of the manhole entrance, formed by the inner surface of the inner sleeve; and 2) a water-proof seal is formed by the rubber ring between the inner sleeve and the ring and between the ring and the underlying manhole lid due to the weight of the casting on the sleeve and ring.

Figure 11:
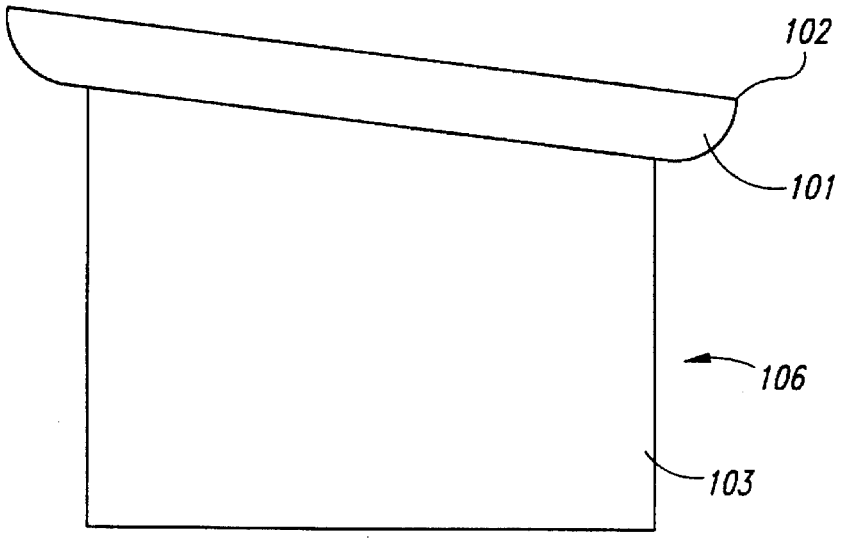
FIG. 11 is an elevation view of a second embodiment of the inner sleeve.

Although a planar flange is preferred for inner sleeve 50, a second embodiment 100 of the invention uses a bell-shaped upper flange 101 as shown in FIG. 11 which flares outwardly and upwardly to support the casting on an upper circumference 102 of greater diameter than the inner cylindrical sleeve 103.

As will be apparent to those skilled in the art, various modifications and adaptations of the structure above described may be made without departing from the spirit of the invention, the scope of which is to be construed in accordance with the accompanying claims.

I claim:

1. A casting positioning apparatus, for positioning a casting in relation to a manhole lid opening and cementing said casting into position, the apparatus comprising:

a) an inner sleeve comprising a rigid cylinder provided at the upper end thereof with an annular flange, the outer diameter of said cylinder being less than the inner diameter of said manhole lid opening;

b) a rubber ring for installing around the outer surface of said cylinder to frictionally engage against the outside of said inner sleeve and comprising a lower surface adapted to bear on the upper edge of said manhole lid, with sufficient force so that the cylinder and the mounted casting can be supported by such engagement, while simultaneously allowing the upper end of the cylinder to be moved with respect to the upper end of the manhole to position the mounted casting with respect thereto;

c) tightening means for tightening said rubber ring against said outer surface of said inner sleeve; and d) outer sleeve means having a diameter greater than said inner sleeve for retaining concrete poured between said inner sleeve and said outer sleeve.

2. The apparatus of claim 1 wherein said means for tightening comprises a circular hose clamp.

3. The apparatus of claim 1 wherein said outer sleeve comprises two planar elongated pieces of flexible material pivotally secured in face-to-face relation at either end thereof.

4. The apparatus of claim 1 further comprising a rung comprising a first horizontal bar and two supports extending perpendicularly to said bar.

5. A method of cementing a casting on a manhole lid opening comprising the steps of:

a) providing a cylindrical inner sleeve having upper and lower edges and a circumferential flange on said upper edge;

b) sliding a rubber ring on said inner sleeve, said rubber ring having an inner diameter less than the outer diameter of said cylinder and an outer diameter greater than said manhole lid opening;

c) placing said inner sleeve on said manhole lid with said rubber ring resting on the upper surface of said manhole lid and applying pressure to said upper edge of said inner sleeve to thereby slide said sleeve to the desired height relative to said manhole;

d) tightening said rubber ring against said inner sleeve;

e) placing said casting on the upper edge of said inner sleeve;

f) providing an outer cylindrical sleeve having a diameter greater than the diameter of said casting around said casting; and g) pouring concrete into the space formed between said inner sleeve and said outer sleeve.

* * * * *